US005094640A

United States Patent [19]

Burdick et al.

[11] Patent Number: 5,094,640

[45] Date of Patent: Mar. 10, 1992

[54] MARINE ENGINE NOISE SUPPRESSOR WITH SWIM PLATFORM

[76] Inventors: Gregory N. Burdick, 458 SW. Salerno Rd.; Robert V. Parenti, 2911 SE. St. Lucie Blvd., both of Stuart, Fla. 34997

[21] Appl. No.: 628,163

[22] Filed: Dec. 14, 1990

[51] Int. Cl.[5] ..... B63H 21/32

[52] U.S. Cl. ..... 440/89; 114/362; 181/235

[58] Field of Search ..... 440/89; 114/362; 118/212, 225, 235, 238, 239; 60/317, 322, 324

[56] References Cited

U.S. PATENT DOCUMENTS 4,744,778 5/1988 Porter ..... 440/89

4,977,977 12/1990 Von Widmann et al. ..... 440/89

*Primary Examiner*—Jesûs D. Sotelo

*Attorney, Agent, or Firm*—Alvin S. Blum

[57] ABSTRACT

Sound muffling devices for marine engines for installation on the external portion of the transom of a marine vessel are attached in such a manner that any breakdown within the silencer causes no discharge of exhaust gases or cooling fluids into the interior of the vessel and the gases and cooling fluid continue to be discharged overboard. The silencers are designed to reduce, substantially, the noise level emitted by the engine under operation by the efficient mixture of gases and water through a series of baffles, with low resistance to gas flow that does not diminish engine efficiency. At high speeds the gases and odors are emitted from the vessel at the centerline with distance and direction such as to reduce, substantially, emissions into the air environment. The device receives exhaust gas and cooling water from an exhaust pipe passing through the transom at the side of the boat and directs the gas athwart the boat to the center where it is exhausted. At low speeds the gas is exhausted at lateral openings at a distance from the transom. These by-pass openings tend to close off at high speed, directing the exhaust to the center, lower openings. The devices are provided in pairs with a central member that may be cut to length to fit between the pair to adapt to any width of boat. The device is designed to be used in pairs, with one for each of a pair of engines mounted side by side with an integral swim platform for its upper surface.

20 Claims, 1 Drawing Sheet

FIG. 6
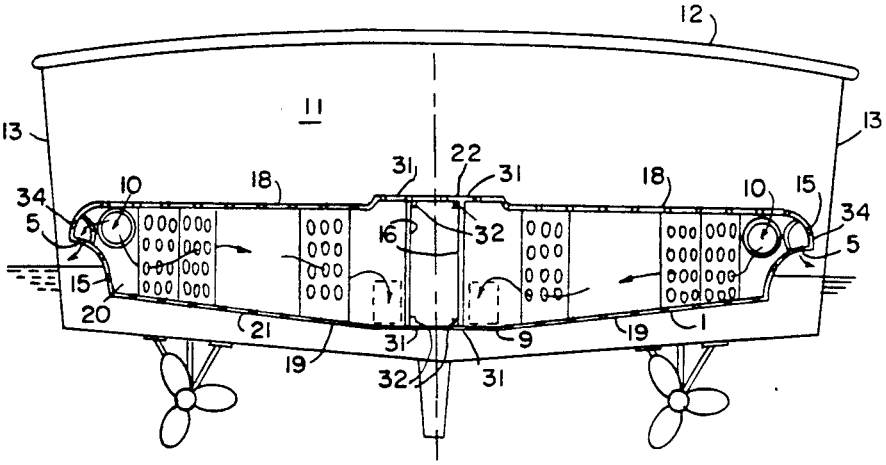
FIG. 4
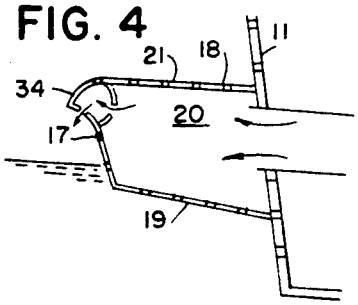
FIG. 5
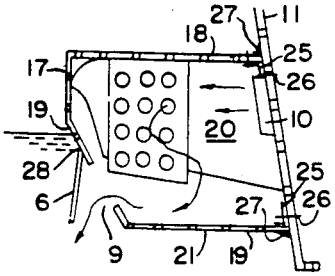
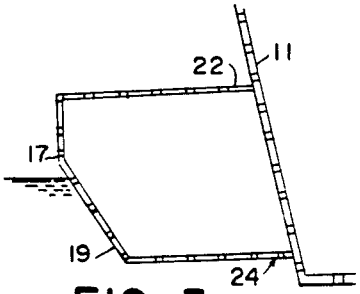
FIG. 3
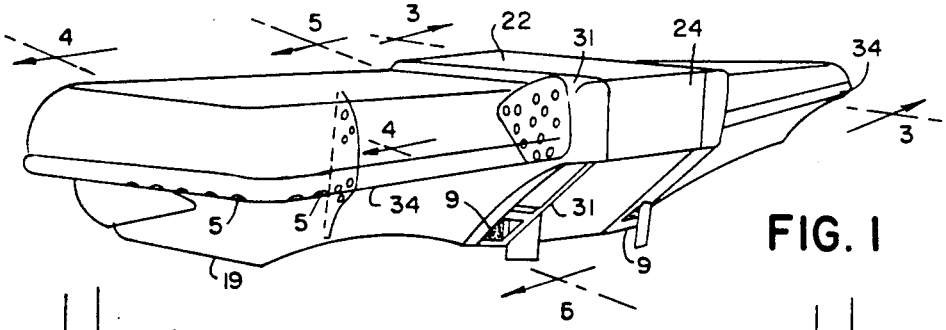
FIG. 1
FIG. 2
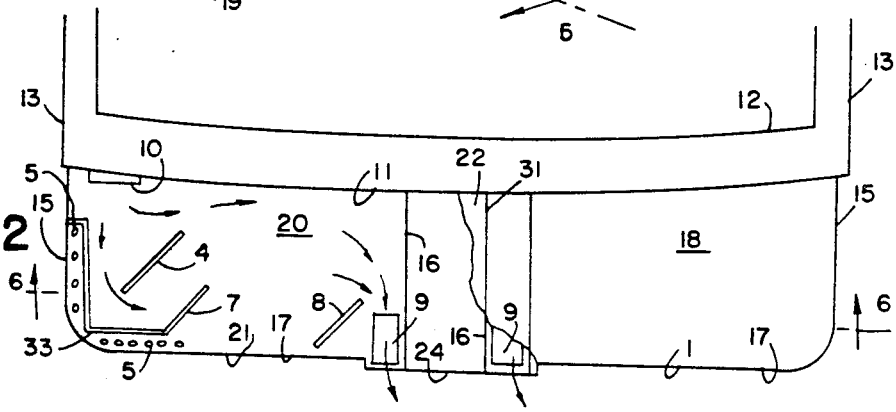

MARINE ENGINE NOISE SUPPRESSOR WITH SWIM PLATFORM

BACKGROUND OF THE INVENTION

This invention relates to a marine engine exhaust system and more particularly to a marine wet exhaust system, which substantially reduces noise, fumes and odor and is mounted on the external portion of the marine vessel, called the transom, and is installed in such a manner as to be functional as a swin platform, a boarding, or a life saving device, facilitating access to the vessel from the waterline, and that provides a separate noise suppression chamber for each of a pair of marine engines in side by side orientation.

Present marine exhaust systems are subject to a variety of serious problems enumerated as follows:

a) designed to muffle sound, they are installed internally within the hull of the vessel. Any breakdown of the composition with which the mufflers are constructed, or breakdown of clamps due to vibration and corrosion, can lead to serious consequences by discharging dangerous fumes and water directly into the interior of the vessel. Because of this danger and the use of the interior space, many vessels using high performance diesel engines are sold without muffled exhaust systems installed;

b) the noise emissions from current marine engines have become intolerable, to an extent they provide a hazard to the operators and passengers of vessels, as well as the general public. Tests and studies show that marine diesel engines, at a crusing speed are operating at a sound level of more than 100 decibels within the immediate area of the vessel. According to the U.S. Department of Labor regulations, any noise level above 100 decibels is an impermissible noise beyond two hours of exposure. 115 decibels is the noise level of many vessels operated by diesel engines. If noise level exceeds 115 decibels, the permissible limit of exposure to that noise level is one-quarter of an hour, or less;

c) exhaust fumes and odor, particularly of diesel engines emitting through the transom exhaust are drawn back into the cockpit by turbulant air flow through what is known as the "stationwagon" effect, thereby endangering and inconveniencing the boat's occupants. Ingestion of toxic exhaust fumes by boat passengers is well documented as a serious threat to public health;

d) internal mufflers increase the heat level of the vessel. Heat levels on cruising vessels are extremely high, particularly with the high performance, turbo charged diesel engines now widely in use. Diesel engines operate most efficiently at temperatures approaching 200 degrees F. Turbo chargers add substantially to heat buildup in the engine room. Considerable heat is retained in the current internal muffler systems, as when the engines are stopped, the muffler retains approximately one third of its volume in water, which rests in the muffler casing and retains heat of high temperature, thereby taking longer for the interior to cool, adding to the discomfort of crew and passengers.

Previous attempts to reduce the noise of marine engines, particularly diesel engines, reducing the odor and fumes from the exhaust systems of the engines, and preventing their backflow into the open rear, or cockpit, of the boat, and reducing internal muffler ambient heat, have been largely unsuccessful. No attempt has been made to solve the most serious problem of all, namely the safety hazard of internal mufflers, by providing a muffler system that is mounted to the exterior of the hull of the vessel, which thereby eliminates any hazard of discharging water or exhaust gases into the interior of the hull, and at the same time projecting the exhaust at a distance farther aft of the vessel, directly into the water, thereby eliminating the flow of fumes and odor into the cockpit of the boat.

In U.S. Pat. No. 4,744,778 issued 5/17/88 to Porter, an external exhaust muffler bolts on the transom and also serves as a swim platform. This muffler is a chamber that extends from one side of the boat to the other with exhaust gas exit ports in line with exhaust gas entrance pipes so that there is no athwart or transverse flow pathway forced on the gas to provide an elongate flow path through the muffler chamber for efficient silencing and gas scrubbing. And gas is not directed to exhaust along the center line. No special provisions are made for changing the exhaust vertical level between slow and planing speeds. Furthermore, the chamber of Porter makes no provision for the large mass of water that will accumulate in the chamber from both the surrounding water and the cooling water mixed with the exhaust. When running in reverse, extensions of the type shown by Porter may tend to dig into the sea and cause water to flow into the boat as well as into the chamber and the engine exhaust pipes causing serious problems.

The exhaust system disclosed in a patent application that will be U.S. Pat. No. 4,977,977 works very effectively at high speeds where the exhaust is pulled through the lowermost, centerline outlets, but at low speeds the centerline uppermost exhaust ports do allow exhaust gases to come in over the transom under some conditions, which is undesirable.

Accordingly, there is a need for a simple, durable, inexpensive, but highly effective, marine exhaust system, which prevents and avoids internal breakdown, reduces substantially noise levels of the marine engines, reduces internal heat levels, provides a life saving and recreational attachment to the vessel, without interfering with engine performance, and prevents exhaust gas from coming in over the transom at both low and high speeds.

SUMMARY OF THE INVENTION

It is accordingly an object of the invention to provide a marine engine exhaust system to fasten to the outside of the transom that directs engine exhaust transverse to the centerline and toward the centerline and provides exit ports substantially at the midline of the boat at high speed operation. This arrangement furnishes a muffler chamber length equal approximately to half the beam. The path length is further extended by a series of internal, perforated baffles for improved sound deadening action. The gas exit means includes an upper opening at the side for slow speed operation and a lower opening near the midline for high speed operation. The lower opening may have occluding flap means for closing the opening automatically when in reverse to prevent water being forced into the exhaust chamber. The lower opening is open and exhaust gases are pulled out this opening near the water surface when the boat is on plane. This causes exhaust gas to be pulled into the wake, preventing it from swirling back into the boat in the "stationwagon" effect. At high speeds, the wake rises up behind the boat and occludes the upper, lateral openings so that the large volume of exhaust gas is directed to the central, lower opening, where the outlet pressure is reduced by the Venturi effect.

At low speeds, the lower, central opening is occluded by a column of water. The small exhaust volume passes out the upper, lateral openings that are directed downward at a point least likely to be swept back in over the transom. The bottom surface of the chamber slopes upwardly from the point of attachment to the transom. When the boat is in reverse, this sloping surface acts as a planing surface lifting the stern and overcoming the tendency of the stern to bury itself in the waves when in reverse. This upward slope of the bottom surface of the exhaust chamber is reversed at the lower gas exit port so that any water in the chamber will drain out this port when the boat is lifted on plane or taken from the water. Since this is a chamber with substantial volume to achieve effective acoustic function, the volume of water would have a considerable weight, and could cause serious problems on freezing as well. The devices are to be employed in pairs in side by side relation with one device muffling a port engine's exhaust and a second device muffling a starboard engine's exhaust. The upper surface of each chamber is arranged to provide a sufficiently broad, flat surface to serve as a swim platform or boarding platform for recreational and safety purposes.

These and other features, objects and advantages of the present invention will become more apparent when the following detailed descriptions of preferred embodiments of the invention are read in conjection with the drawings.

BRIEF DESCRIPTION OF THE DRAWINGS

FIG. 1 is a perspective view of the invention viewed from behind the port side of a boat.

FIG. 2 is a top view of the invention with a portion of the top surface broken away, looking down on the invention as it would be installed on the transom, showing a typical baffle configuration and direction of water and exhaust flow.

FIG. 3 is a cross sectional view taken on line 3—3 of FIG. 1.

FIG. 4 is a cross sectional view taken on line 4—4 of FIG. 1.

FIG. 5 is a cross sectional view taken on line 5—5 of FIG. 1.

FIG. 6 is a cross sectional view taken on line 6—6 of FIG. 2.

DETAILED DESCRIPTION OF PREFERRED EMBODIMENTS

Referring more particularly to the drawings and initially to FIGS. 1, 2, 6, there is shown a boat 12 having side walls 13 and a transom or rear wall 11 with engine exhaust pipes 10 extending through transom 11. Ordinarily, these pipes run adjacent the side walls just above the water line and may have covering flaps to prevent ingress of water when running in reverse or in a following sea. It is the usual practice to pump seawater along with the exhaust gas through the exhaust system for cooling. A starboard silencer 1 and a port silencer 21 of the invention are fastened to the transom 11, side by side. Each silencer has a lateral sidewall 15, a central side wall 16 and a rear wall 17. A top surface 18 which is generally flat to serve as a swim platform and a bottom 19 connect the sidewalls and rear wall which define an inner acoustic chamber 20 when applied to the transom which serves as the forward wall of the chamber 20 when the silencer is sealed against the transom by sealing means such as caulking or gaskets 27 (FIG. 5).

Each silencer is mounted on one side of the transom so that the lateral sidewall 15 is substantially in line with the side 13 of the boat for hydrodynamic efficiency. It is located vertically so that the lateral exhaust pipe 10 is enclosed by the lateral portion of the acoustic chamber 20. The rear wall 17 of the silencer has upper lateral exhaust ports 5. The lower exhaust ports 9 are located close to the central sidewall 16 so that exhaust gas leaving the port 10 must change direction ninety degrees and move toward the centerline of the boat and then change direction ninety degrees again to exit through the exhaust ports 9. This provides a long outboard muffler that doesn't extend a great distance beyond the transom. It can be as long as half the beam. The path is extended and diverted by a plurality of perforated baffles, 4, 7, 8 for enhanced noise reduction. With diesel engines, it is important to avoid restriction of exhaust flow because this interferes with correct operation and produces noxious emissions. The central sidewalls 16 of the two mufflers are shown spaced apart from one another with the top surface 22 between the two provided by a central segment 24.

For commercial economy in molding a product that will be more versatile in fitting a number of boats of varying beam, the preferred embodiment has a width between lateral sidewall and central sidewall small enough to fit the narrowest beam for which the product is designed, when the two central sidewalls are juxtaposed. A central segment 24 extends centrally between central sidewalls 16. As much of this segment 24 is cut off as is necessary so that the two top surfaces of port and starboard mufflers will meet in butt joint seams 31 where the segment 24 fits into ledges 32 molded into the mufflers for a smooth surface adaptable to a boat of any beam.

It will be seen in FIGS. 1 and 2, where the two mufflers are installed on a boat with broad beam, that the two central sidewalls 16 are spaced apart and segment 24 spans the gap therebetween to form a complete top surface.

The housing is preferably molded of glass fiber reinforced plastic. The baffle plates may be of perforated plastic or metal. As best shown in the cross sectional views, FIGS. 3-5, the bottom 19 slopes upwardly from its attachment to the transom 11 except at the central wall where the exhaust outlet port 9 penetrates the rear wall 17. This upward slope provides an upward thrust on the transom when in reverse which overcomes the tendency to dig in and spill water into the boat. The bottom 19 also slopes toward the central sidewall (FIG. 6) so that any water in chamber 20 drains out lower exhaust port 9. This reduces the weight when on plane and prevents damage from water trapped in the chamber freezing in winter layup.

As shown in FIG. 5, stainless steel angle brackets 25 bolted to muffler 21 and transom 11 with through bolts 26 hold the muffler securely in place. Sealant 27 in the form of calking or gaskets provide a gas tight seal. Lower flap 6 pivoted on pivot 28 is pushed closed in reverse preventing water from entering chamber 20 when running in reverse. Since lower exhaust port 9 is underwater at low speed, gas normally exits through upper, lateral exhaust ports 5 at idle or low speed which are directed downward to the water immediately below. At high speed, flap 6 is pulled open and the force of water rushing past port 9 creates a vacuum, sucking exhaust gas out port 9 and into the churning wake where it is pulled into the water, well behind and below the boat, thereby preventing the gas from entering the boat and moving exhaust through a long, baffled chamber for effective sound suppression. The exhaust is delivered at a level about two feet below that of conventional exhausts. The baffles may be attached to upper, lower or rear wall of the muffler as required.

At high speed operation, the wake rises up behind the boat, covering the upper, lateral apertures 5 and washing away any small amount of gas that may pass through. Because the suction action at the lower port 9 yields a lower pressure at 9 than at 5, most of the exhaust gas takes the longer route to the lower central exhaust ports 9 whereby it is effectively muffled and mixed with the wake, preventing its passing over the transom.

At low speed and at rest, the lower central exhaust ports 9 are below at least a foot of water preventing exhaust from escaping. The lateral, upper ports 5 are exposed and serve as a by-pass for the smaller, and quieter gas flow at low engine RPM. Secondary baffles 33 may be provided to elongate and muffle the gas pathway.

Extending around the outer edge of the external mufflers is a projecting ridge 34 that serves several purposes. Its shape stiffens the housing structure. It serves as a rub rail. And the apertures 5 along its underside at a distance from the transom serve as the upper lateral exhaust ports, positioned where they are washed by the wake when the boat is running at high speed and directing exhaust downward, away from the transom and into the water at slow speed.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. An exhaust muffler device for a motor boat having a centerline, two sides and a transom with an exhaust pipe passing engine exhaust gas through a port half of the transom and an exhaust pipe passing engine exhaust gas through a starboard half of the transom, said muffler device comprising:

a) a lateral sidewall adjacent one of said sides of said boat and having a leading edge for attachment to said transom;

b) a central sidewall adjacent said centerline of said boat and having a leading edge for attachment to said transom;

c) a top extending between the two sidewalls and forming a swimming platform and having a leading edge for attachment to said transom;

d) a bottom extending between the two sidewalls and having a leading edge for attachment to said transom;

e) a rear wall extending from said top to said bottom between said sidewalls;

f) an upper exhaust port means in said lateral sidewall adjacent said rear wall for exhausting gas at low speed;

g) a lower exhaust port means in said rear wall adjacent said central sidewall and said bottom for exhausting gas at high speeds;

h) said bottom generally sloping upward from said leading edge to said rear wall except at said lower exhaust port means wherein the slope is reversed to provide drainage and for discharging said exhaust gas at a low level;

i) said sidewalls, said top and said bottom defining an acoustic chamber when said leading edges are sealingly connected to one half of said transom thereby enclosing said exhaust pipe and providing a path for said exhaust gas for noise reduction and to direct said gas away from said boat.

2. The device according to claim 1 including baffle means connected within said chamber to enhance noise reduction.

3. The device according to claim 2 in which said baffle means are perforated.

4. The device according to claim 1 including movable flap means for covering said lower exhaust port means when water is directed externally against said exhaust port means.

5. A pair of devices according to claim 1 including a first device arranged to fit on said port side of the transom, a second device arranged to fit on said starboard side of the transom and a central member arranged to fit between the central sidewalls of said first and second devices to form a continuous top with said devices.

6. The pair of devices according to claim 5 in which said central member includes a rear wall and a bottom.

7. The device according to claim 5 further comprising an external ridge means for extending out from said lateral sidewall and said rear wall, in which said upper exhaust port means are in the form of apertures in the underside of said external ridge means.

8. The device according to claim 1 further comprising an external ridge means for extending out from said lateral sidewall and said rear wall, in which said upper exhaust port means are in the form of apertures in the underside of said external ridge means.

9. The device according to claim 8 in which said upper exhaust port means are arranged to be closed off at high speeds and said lower exhaust port means are arranged to be closed off at low speeds.

10. The device according to claim 1 in which said upper exhaust port means are arranged to be closed off at high speeds and said lower exhaust port means are arranged to be closed off at low speeds.

11. An exhaust muffler device for a motor boat having a centerline, two sides and a transom with an exhaust pipe passing engine exhaust gas through a port half of the transom and an exhaust pipe passing engine exhaust gas through a starboard half of the transom, said muffler device comprising:

a) a lateral sidewall adjacent one of said sides of said boat and having a leading edge for attachment to said transom;

b) a central sidewall adjacent said centerline of said boat and having a leading edge for attachment to said transom;

c) a top extending between the two sidewalls and forming a swimming platform and having a leading edge for attachment to said transom;

d) a bottom extending between the two sidewalls and having a leading edge for attachment to said transom;

e) a rear wall extending from said top to said bottom between said sidewalls;

f) an upper exhaust port means in said lateral sidewall adjacent said rear wall for exhausting gas at low speed;

g) a lower exhaust port means in said rear wall adjacent said central sidewall and said bottom for exhausting gas at high speeds;

h) said bottom generally sloping upward from said leading edge to said rear wall except at said lower exhaust port means wherein the slope is reversed to provide drainage and for discharging said exhaust gas at a low level;

i) said sidewalls, said top and said bottom defining an acoustic chamber when said leading edges are sealingly connected to one half of said transom thereby enclosing said exhaust pipe and providing a path for said exhaust gas for noise reduction and to direct said gas away from said boat.

12. An exhaust muffler device for a motor boat having a centerline, two sides and a transom with an exhaust pipe passing engine exhaust gas through a port half of the transom and an exhuast pipe passing engine exhaust gas through a starboard half of the transom, said muffler device comprising:

a) a lateral sidewall adjacent one of said sides of said boat and having a leading edge for attachment to said transom;

b) a central sidewall adjacent said centerline of said boat and having a leading edge for attachment to said transom;

c) a top extending between the two sidewalls and forming a swimming platform and having a leading edge for attachment to said transom;

d) a bottom extending between the two sidewalls and having a leading edge for attachment to said transom;

e) a rear wall extending from said top to said bottom between said sidewalls;

f) lateral, upper exhaust port means for exhausting gas at low speeds, said upper exhaust port means located above the water line of said boat at rest at selected sites along a line extending from a point on said rear wall at least half way to said central sidewall, said sites including at least one site on said lateral sidewall;

g) a lower exhuast port means in said rear wall adjacent said central sidewall and said bottom for exhausting gas at high speeds;

h) said bottom generally sloping upward from said leading edge to said rear wall except at said lower exhaust port means wherein the slope is reversed to provide drainage and for discharging said exhaust gas at a low level;

i) said sidewalls, said top and said bottom defining an accustic chamber when said leading edges are sealingly connected to one half of said transom thereby enclosing said exhaust pipe and providing a path for said exhaust gas for noise reduction and to direct said gas away from said boat.

13. The device according to claim 12 including baffle means connected within said chamber to enhance noise reduction.

14. The device according to claim 12 including movable flap means for covering said lower exhaust port means when water is directed externally against said exhaust port means.

15. The device according to claim 12 further comprising an external ridge means for extending out from said lateral sidewall and said rear wall, in which said upper exhaust port means are in the form of apertures in the underside of said external ridge means.

16. The device according to claim 12 in which said upper exhaust port means are arranged to be closed off at high speeds and said lower exhaust port means are arranged to be closed off at low speeds.

17. A pair of devices according to claim 12 including a first device arranged to fit on said port side of the transom, a second device arranged to fit on said starboard side of the transom and a central member arranged to fit between the central sidewalls of said first and second devices to form a continuous top with said devices.

18. The pair of devices according to claim 17 in which said central member includes a rear wall and a bottom.

19. The pair of devices according to claim 17 further comprising an external ridge means for extending out from said lateral sidewall and said rear wall, in which said upper exhaust port means are in the form of apertures in the underside of said external ridge means.

20. The pair of devices according to claim 17 in which said upper exhaust port means are arranged to be closed off at high speeds and said lower exhaust port means are arranged to be closed off at low speeds.

* * * * *